US005098059A

United States Patent [19]

Sawyer

[11] Patent Number: 5,098,059

[45] Date of Patent: Mar. 24, 1992

[54] CONCRETE FORMING MEMBER FOR USE IN CONCRETE CASTING

[76] Inventor: Robert D. Sawyer, 6365 S. 20th St., Apt. 15, Oak Creek, Wis. 53154

[21] Appl. No.: 508,043

[22] Filed: Apr. 11, 1990

[51] Int. Cl.[5] ..... E04G 9/05

[52] U.S. Cl. ..... 249/16; 52/309.7; 52/309.9; 249/112; 249/114.1; 249/134; 249/177; 249/189; 428/317.1; 428/319.9

[58] Field of Search ..... 249/18, 33, 35, 15, 249/16, 111, 112, 114.1, 115, 134, 177, 183, 189, 175, DIG. 3; 52/309.7, 309.8, 309.9, 309.16; 428/317.1, 317.7, 319.3, 319.7, 319.9

[56] References Cited

U.S. PATENT DOCUMENTS

| | | | |
|---|---|---|---|
| 1,712,678 | 5/1929 | Redman | 249/16 |
| 2,627,100 | 2/1953 | Jelks | 249/27 |
| 2,674,775 | 4/1954 | Willson | 249/189 |
| 2,896,271 | 7/1959 | Kloote et al. | 249/189 |
| 3,194,708 | 7/1965 | Fourcade et al. | 428/317.1 |
| 3,291,436 | 12/1966 | Berghammer | 249/189 |
| 3,295,818 | 1/1967 | Kreier, Jr. | 249/134 |
| 3,317,178 | 5/1967 | Kreier, Jr. | 249/134 |
| 3,350,049 | 10/1967 | Reiland | 249/48 |
| 3,381,929 | 5/1968 | Bancker | 249/5 |
| 3,531,367 | 9/1970 | Karsten | 428/319.9 |
| 3,703,572 | 11/1972 | Bellasalma | 249/112 |
| 3,831,897 | 8/1974 | Stegmeier | 249/DIG. 3 |
| 3,844,527 | 10/1974 | Scott | 249/189 |
| 4,017,051 | 4/1977 | Scott et al. | 249/50 |
| 4,037,816 | 7/1977 | Scott | 249/83 |
| 4,116,415 | 9/1978 | Ward | 249/189 |
| 4,133,930 | 1/1979 | Wright et al. | 428/319.9 |
| 4,150,808 | 4/1979 | Sawyer | 249/189 |
| 4,181,286 | 1/1980 | Van Doren | 249/82 |
| 4,201,609 | 5/1980 | Olsen | 428/319.9 |
| 4,260,569 | 4/1981 | Hurst | 428/317.1 |
| 4,659,618 | 4/1987 | Yazaki et al. | 428/319.9 |
| 4,687,534 | 8/1987 | Alford et al. | 428/319.9 |
| 4,758,299 | 7/1988 | Burke | 428/317.1 |
| 4,900,616 | 2/1990 | Weir et al. . | |

FOREIGN PATENT DOCUMENTS

| | | | |
|---|---|---|---|
| 77579 | 4/1983 | European Pat. Off. | 249/189 |
| 2146993 | 3/1973 | France | 428/319.9 |
| 2292090 | 6/1976 | France | 249/189 |
| 2342385 | 9/1977 | France | 52/309.9 |
| 59-40096 | 9/1984 | Japan | 249/189 |
| 2-69228 | 3/1990 | Japan | 428/319.9 |
| 1305808 | 2/1973 | United Kingdom | 428/319.9 |
| 1354172 | 5/1974 | United Kingdom | 428/319.9 |

*Primary Examiner*—James C. Housel
*Attorney, Agent, or Firm*—Michael, Best & Friedrich

[57] ABSTRACT

An assembly comprising a foam piece adapted for use in concrete casting, the foam piece having a front surface, a back surface, and edges, the assembly further comprising a flexible, non-permeable plastic film surrounding the foam piece. In one aspect of the invention, the plastic film surrounding the foam piece is heat shrunk. In another aspect of the invention, the foam piece defines a block out for use in concrete casting. The assembly may include a wood beam in a groove in the foam piece, which beam can receive nails so that the assembly can be secured to a concrete casting form. The plastic film allows the foam piece to be easily removed from hardened concrete and reused.

29 Claims, 3 Drawing Sheets

CONCRETE FORMING MEMBER FOR USE IN CONCRETE CASTING

FIELD OF THE INVENTION

The invention relates generally to concrete forming devices including form liners and brick ledge block outs. The invention also relates to form liners and block outs which are relatively easily removable from hardened concrete.

BACKGROUND OF THE INVENTION

Polystyrene and polyurethane forms are inexpensive materials to use as concrete forming devices, but such foam devices, due to their surface porosity and lack of structural integrity, can be quite difficult to remove in one piece from cured concrete.

It is known to provide liners for concrete forms, which liners are adapted for facilitated removal from cured concrete. For example, U.S. Pat. No. 3,844,527 to Scott, discloses a water permeable form liner for imparting a decorative pattern to poured concrete, this form liner also functioning to aid in the curing of concrete. These form liners are formed of integral skin foam or self skinning elastomeric plastic, such as polyurethane, the skin being of the same material as the rest of the form liner, and the skin facilitating the removal of the form liner from the hardened concrete. U.S. Pat. No. 4,017,051 to Scott et.al., discloses a smooth, rigid, non-stick plastic sheet liner for a concrete form which allows for simplified removal of the forms from the concrete, after the concrete sets. U.S. Pat. No. 3,350,049 to Reiland, illustrates bracing material for use in casting concrete columns and comprised of foamed plastic material such as foamed polystyrene or foamed polyurethane.

Attention is directed to the following U.S. patent documents, which relate to molds for forming concrete:

| INVENTOR | U.S. PAT. NO. | ISSUED |
|---|---|---|
| Van Doren | 4,181,236 | January 1, 1980 |
| Scott | 4,037,816 | July 26, 1977 |
| Kreier, Jr. | 3,317,178 | May 2, 1967 |
| Kreier, Jr. | 3,295,818 | January 3, 1967 |

SUMMARY OF THE INVENTION

The invention provides a foam piece adapted for use in concrete casting, which foam piece is made of a material such as polystyrene or polyurethane foam, and which foam piece is easily removed from cured concrete.

The invention also provides a method for manufacturing a reusable insulating reusable concrete forming device that facilitates fast curing of poured concrete.

The invention also provides a method for manufacturing an inexpensive insulating form liner that can impart a pattern to poured concrete or a block out device for use in forming a brick ledge and that can easily be removed from the concrete after it cures.

The invention provides, in one aspect, a method for treating a foam piece adapted for use in concrete casting, the method comprising the steps of appending a flexible, non-permeable plastic film sheet to a surface of the foam piece, which surface is adapted to face a concrete casting area.

The invention also includes a process for manufacturing a concrete forming device wherein a heat shrinkable plastic film is placed around a foam polystyrene or polyurethane product and the plastic film is then heated to cause the plastic film to shrink around the foam product such that the plastic film encapsulates the foam product and forms a plastic film layer completely surrounding the foam product. The heat shrinkable plastic film can include an adhesive layer adjacent the surfaces of the foam product to provide for further bonding of the film to the surfaces of the foam product.

The invention also provides a method for treating a foam piece adapted for use in casting concrete, and having a front surface adapted to face a concrete casting area, a back surface opposite the front surface, and edges, the process comprising the steps of placing the foam piece in a chamber with one of the front and back surfaces of the foam piece facing upwardly; placing a first sheet of plastic film on the foam piece so that the first sheet contacts the upwardly facing surface of the foam piece, and so that the first sheet covers the edges of the foam piece; heating the first sheet of plastic film; evacuating air from the chamber; inverting the foam piece in the chamber so that the other of the first and second surfaces of the foam piece faces upwardly; placing a second sheet of plastic film on the foam piece so that the second sheet contacts the upwardly facing surface of the foam piece, and so that the second sheet overlaps a portion of the first sheet over the edges of the foam piece; heating the second sheet of plastic film; and evacuating air from the chamber.

The invention further provides an assembly comprising a foam piece adapted for use in concrete casting and having a front surface, a back surface, and edges, said assembly further comprising a flexible, non-permeable plastic film appended to at least the front surface of the foam piece.

In one embodiment of the invention, a flexible non-permeable plastic film is appended to the back surface of the foam piece.

In one embodiment of the invention, the plastic film appended to the front surface is defined by a first sheet of plastic film, the plastic film appended to the back surface is defined by a second sheet of plastic film and the first and second sheets overlap to cover at least one edge of the foam piece.

In one embodiment of the invention, the foam piece consists essentially of expanded polystyrene.

In one embodiment of the invention, the front surface of the foam piece is contoured.

In one embodiment of the invention, a structural element is appended to the back surface of the foam piece.

In one embodiment of the invention, a non-solvent release agent, such as corn-oil or non-detergent motor oil is applied to the plastic film coating the foam piece.

The invention further provides a process for forming concrete, the process comprising the steps of providing a foam piece having a surface adapted to face a concrete casting area; appending a non-permeable plastic film to at least the surface adapted to face a concrete casting area, thereby defining an assembly; positioning at least one assembly in place with a plastic coated surface facing toward a concrete casting area; and pouring concrete into the concrete casting area.

These and other features, objects and advantages of the invention will become apparent to those skilled in the art upon review of the following detailed description of the preferred embodiment of the invention.

DETAILED DESCRIPTION OF THE PREFERRED EMBODIMENTS OF THE INVENTION

Figure 1:
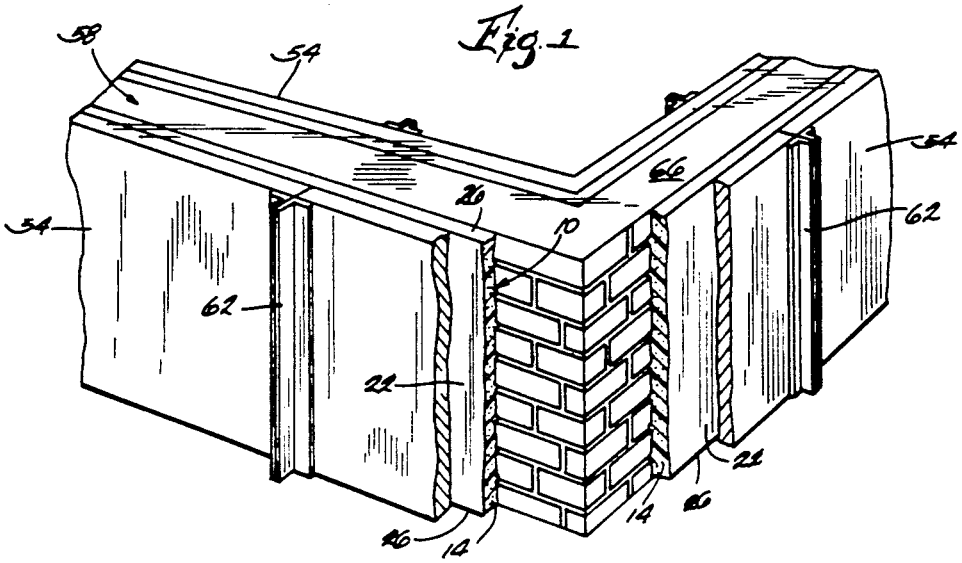
FIG. 1 is a perspective view, partially broken away, of concrete forms and form liners embodying various features of the invention and being used for concrete casting.
Figure 2:
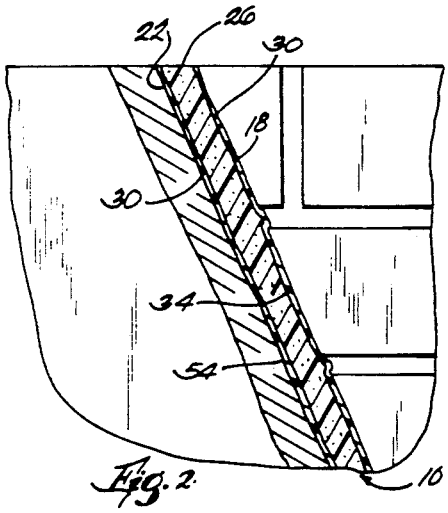
FIG. 2 is an enlarged detail view showing a broken away section of the concrete forms and form liners of FIG. 1.

Shown in FIG. 1 is an assembly 10 comprising a foam piece or form liner 14 for use in concrete casting, the form liner 14 having a front surface 18. The form liner 14 further includes a back surface 22, and edges 26. The form liner 14 could be formed of high density Styrofoam. In the preferred embodiment of the invention, however, the form liner 14 is formed of low density expanded polystyrene or polyurethane foam for greater economy. While in other embodiments the form liner could have a smooth planar front surface, in the illustrated arrangement, the front surface 18 of the form liner 14 is contoured to define a decorative pattern for impartation to cast concrete.

The assembly 10 further includes a flexible, non-permeable plastic film appended to at least the front surface 18 of the form liner 14 so that at least the portion of the front surface 18 that is adapted to face poured concrete is covered with plastic film. Optionally, but preferably, plastic film is also appended to the back surface 22 of the foam. In one embodiment of the invention, the plastic film appended to the front surface 18 is defined by a first sheet of plastic film 30, and the plastic film appended to the back surface 22 is defined by a second sheet of plastic film 30. Preferably, at least one edge 26 of the foam piece 14 is covered by at least one of the first and second sheets of plastic film 30. More particularly, the first and second sheets of plastic film 30 overlap to cover at least one edge 26 of the foam piece 14. More particularly, in the preferred embodiment, the sheet 30 of plastic film that covers the front surface 18 also covers the edges 26, and preferably covers a small portion of the back surface 22 (see FIG. 11), and the second sheet 30 of plastic film overlaps the portion of the sheet 30 that covers the edges 26 and that covers the small portion of the back surface 22. The second sheet 30 preferably extends over a small portion of the front surface 18 (see FIG. 12), so that the edges 26 are covered by two sheets 30 of plastic film. Thus, the foam 14 of the preferred assembly 10 is entirely encapsulated in plastic film. By completely encapsulating the foam 14 in plastic film, the strength of the assembly 10 is greatly increased. Nails can be more easily driven into the foam piece 14 when the foam piece 14 is entirely encapsulated in plastic film.

In one embodiment of the invention the plastic film includes a surface 34 having an adhesive 36 thereon for improved adhesion to the foam 14. More particularly, in that embodiment, the sheet 30 of plastic film is of the type sold with an adhesive on the surface 34 thereof, such as product no. X064300.45 sold by Dow Chemical Co. of Midland, Mich., which product is a co-extruded olefin based heat activated film. If a non-adhesive film is used, an appropriate non-adhesive film product could be a mono-layer olrphant based film sold by Dow Chemical. The sheet 30 of plastic film (adhesive or non-adhesive) could optionally be of a type that is fiber glass or nylon mesh reinforced. While various dimensions may be appropriate, in one embodiment, the sheet 30 of plastic film is approximately 10 mils thick, and the foam piece 14 is approximately 1 inch thick.

Figure 15:
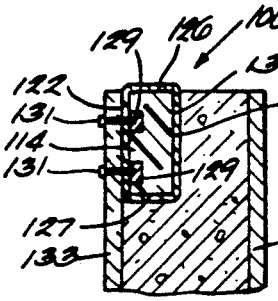
FIG. 15 illustrates a brick ledge block out embodying the invention and used in a concrete casting operation.

In an alternative embodiment of the invention shown in FIG. 15, the concrete forming device comprises a brick ledge block out 100 comprised of an elongated piece of expanded polystyrene foam 114 or the like, and being generally rectangular in cross section, the length of foam having a front surface 118, a back surface 122, and top and bottom surfaces 126 and 127, respectively. The block out 100 shown in FIG. 15 further includes a flexible, non-permeable plastic film 130 surrounding the foam and defining a smooth surface. The block out is supported between a pair of concrete forms 133 such that the front surface 118 and the bottom surface 127 of the block out each define concrete casting surfaces for forming a brick ledge in the cast concrete structure. More particularly, while the plastic film could be applied to the foam in other ways, in the embodiment illustrated in FIG. 15, the flexible non-permeable film is wrapped around the elongated foam block and then heated sufficiently to cause the film to heat shrink tightly against the surfaces of the foam. In a preferred form of the invention the plastic film can comprise Dow Chemical X064300.45 film including an adhesive layer. When the film is heated and shrinks against the foam, the adhesive will further bond the film to the surface of the foam. While the film surrounding the foam increases the rigidity and strength of the foam, in the illustrated arrangement a pair of elongated grooves are formed in one side of the foam block and house elongated wooden strips 129. The wooden strips 129 can be held in place by adhesive and by the film layer 130. The wooden strips 129 increase the strength of the elongated block out and permit the block out to be secured to the form 133 by nails 131 driven through holes in the form into the wooden strips.

In another embodiment of the invention, shown in FIGS. 4–6, and 14, an assembly 200 is provided comprising a foam piece 214 adapted for use in concrete casting, the foam piece 214 having a front surface 218, a back surface 222, and edges 226. The assembly 200 further comprises a flexible, non-permeable plastic film appended to the front surface 218 of the foam piece 214. The assembly 200 further includes a structural element 238 appended to the back surface 222 of the foam piece 214. More particularly, the structural element 238 preferably has edges 240 aligned with the edges 226 of the foam piece 214, and the plastic film covers the edges 240 of the structural element. The structural element 238 has a front surface 244 facing the foam piece 214, and a back surface 248 opposite the front surface of the structural element 238. The assembly 200 further comprises a flexible, non-permeable film appended to the back surface of the structural element. More particularly, in the embodiment illustrated in FIGS. 4–6 and 14, the plastic film appended to the front surface 218 of the foam piece 214 is defined by a first sheet of plastic film 30. The plastic film appended to the back surface of the structural element is defined by a second sheet of plastic film 30, and the first and second sheets 30 overlap to cover all of the edges of the foam piece 214. While the foam piece 214 shown in FIGS. 4–6 and 14 defines a form liner, other configurations are possible. In the assemblies 200 shown in FIGS. 4–6, the structural element 238 comprises deformable cardboard. In the assembly 200 shown in FIG. 6, the deformable cardboard element is formed of corrugated cardboard. In the assembly 200 shown in FIG. 5, the deformable cardboard element is formed of a honeycomb lattice cardboard structure.

Figure 14:
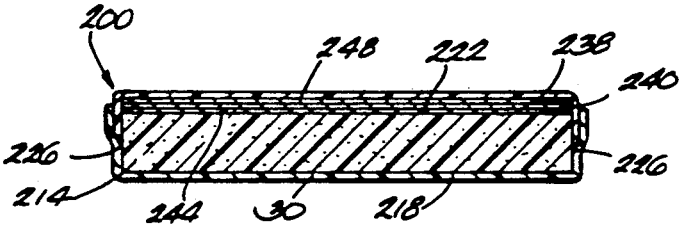

In the assembly 200 shown in FIG. 14, the structural element 238 comprises a wood panel.

The assembly 200 shown in FIGS. 4–6 and 14 is preferably substantially identical to the assemblies 10 and 100, except that the structural element 38 is appended to the foam piece 214, and it is the combination of the foam piece 214 and the structural element 238 that is preferably encased in plastic.

Figure 13:
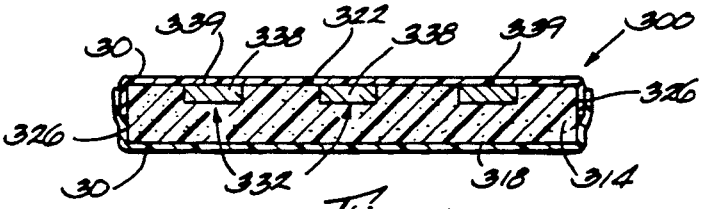
FIGS. 13 and 14 illustrate additional alternative embodiments of the invention.

In another embodiment of the invention, shown in FIG. 13, an assembly 300 is provided comprising a foam piece 314 adapted for use in concrete casting, the foam piece 314 having a front surface 318, a back surface 322, and edges 326. The assembly 300 further comprises a flexible, non-permeable plastic film appended to the front surface 318 of the foam piece 314. The foam piece 314 has at least one groove 332 defined therein and extending from the back surface 322 of the foam piece 314 toward the front surface 318 of the foam piece 314. The assembly 300 further includes a wood beam 338 in each of the grooves 332, each wood beam including a surface 339 that defines a portion of the back surface 322 of the foam piece. The assembly 300 further comprises a flexible, non-permeable plastic film appended to the back surface of the foam piece. More particularly, in the assembly 300, the plastic film appended to the front surface 318 is defined by a first sheet of plastic film 30. The plastic film appended to the back surface 322 is defined by a second sheet of plastic film 30, and the first and second sheets overlap to cover at least one of the edges 326 of the foam piece 314. In the embodiment shown in FIG. 13, the first and second sheets 30 of plastic film overlap so that all of the edges 326 of the foam piece are covered with plastic film. The assembly 300 is substantially identical to the assembly 10, except that the foam piece 314 includes the groove(s) 332, and the assembly 300 includes the wood beam(s) 338 in the groove(s), the combination of the foam piece 314 and the wood beam(s) 338 being encased in plastic.

The assemblies 10, 100, 200, and 300 can be manufactured using a substantially identical process, which process will now be set forth.

Illustrated in FIGS. 7–10 is a process for treating a foam piece 14 adapted for use in concrete casting, the foam piece 14 having a front surface 18 adapted to face a concrete casting area, a back surface 22 opposite the front surface 18, and edges 26, the process including the step of appending a flexible, non-permeable plastic film to the surface 18 of the foam piece 14. Preferably, the plastic film is defined by a sheet 30 of plastic film.

Preferably, but optionally, an adhesive 36 is applied to a surface 34 of the sheet 30 of plastic film before the sheet 30 of plastic film is appended to one of the surfaces of the foam piece 14 for adhesion of the plastic film to the surface of the form liner. More particularly, in the preferred embodiment, the sheet 30 of plastic film is of the type sold with an adhesive 36 on a surface 34 thereof, such as product no. X064300.45 sold by Dow Chemical Co. of Midland, Mich., which product is a co-extruded olefin based heat activated film. The adhesive or non-adhesive film used could optionally be of a type that is fiber glass or nylon mesh reinforced. If a non-adhesive film is used, an appropriate non-adhesive film would be a mono-layer olefin based film sold by Dow Chemical.

Also preferably, but optionally, the surface 18 of the foam piece 14 is decoratively contoured before the sheet 30 of plastic film is appended to the surface 18 of the foam piece 14.

Preferably, but optionally, the process further comprises the step of appending a flexible, non-permeable plastic film to the surface 22 of the foam piece 14. Preferably, the plastic film is defined by a second sheet 30 of plastic film.

In one embodiment of the invention the process for treating a foam piece 14 (or 114, 214, or 314) adapted for use in concrete casting more particularly comprises the following steps.

First, the foam piece 14 is placed on a grid 42 in a chamber 44 with one of the front and back surfaces, 18 and 22, respectively, facing upwardly. See FIG. 7 which shows the foam piece 14 placed on the grid 42 with the front surface 18 facing upwardly.

Next, the first sheet 30 of plastic film is placed on the foam piece 14 so that the adhesive surface 34 at the first sheet contacts the upwardly facing surface of the foam piece 14, and so that the first sheet 30 covers the edges 26 at the foam piece 14. See FIG. 8.

Next, the first sheet 30 of plastic film is heated. See FIG. 9 which shows the first sheet 30 of plastic film being heated, from above the foam piece 14, by a heater 50.

Figure 11:
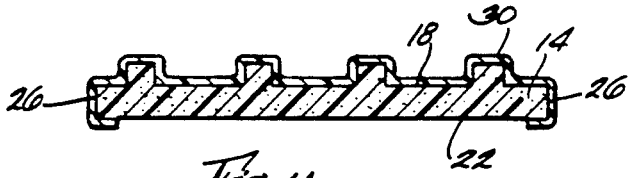

Next, air is evacuated from the chamber 44 from underneath the grid 42. See FIG. 10 which shows air being evacuated from the chamber 44 from underneath the grid 42 by a vacuum source 52. The resulting product is shown in FIG. 11, which product can be used without being subjected to the following optional process steps.

In the first optional step, the foam piece 14 is then inverted on the grid 42 so that the other of the front and back surfaces, 18 and 22, respectively, faces upwardly.

A second sheet 30 of plastic film is then placed on the foam piece 14 so that the adhesive surface 34 of the second sheet 30 contacts the upwardly facing surface of the foam piece, and so that the second sheet 30 overlaps a portion of the first sheet 30 over the edges of the foam piece 145.

The second sheet 30 is then heated, for example by means of the heater 50.

Figure 12:
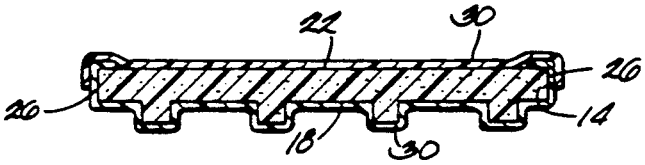

Air is then again evacuated from underneath the grid 42, for example by means of the vacuum source 52. The resulting assembly 10 is shown in FIG. 12.

As previously mentioned, the above described process can also be used to form the assemblies 100, 200 and 300. For example, one process in accordance with the invention further comprises the steps of providing at least one groove 332 in the foam piece 314, the groove 332 extending from the back surface 322 of the foam piece 314 toward the front surface 318 of the foam piece 314, and placing a wood beam 338 in each groove 332 so that each wood beam 338 in each groove 332 includes a surface 339 that defines a portion of the back surface of the foam piece 314, before one at the first and second sheets 30 at the plastic film is placed on the back surface of the foam piece 314.

While application of the sheet 30 of plastic film to the foam piece 14 can be accomplished by the above described process, in other forms of the invention the film could be a shrinkable film applied to a surface of the foam piece 14 and then caused to shrink by an application of heat, or some other means, in a fashion similar to that used to shrink wrap fungible produce.

Figure 3:
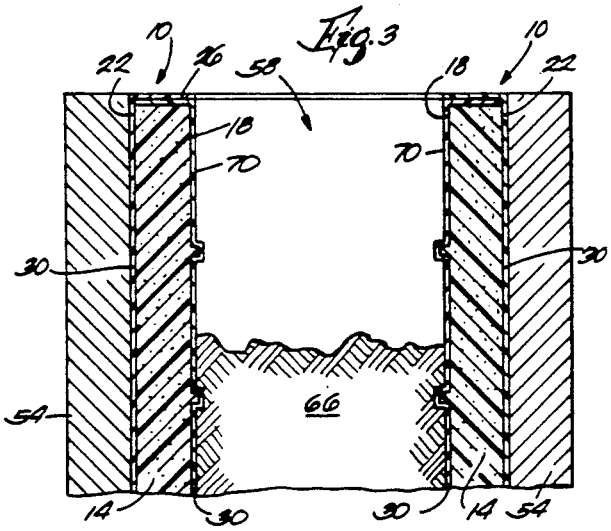
FIG. 3 is an end view of the concrete forms and form liners such as those shown in FIG. 1 and arranged to define a concrete casting area, and illustrates concrete being poured into the area between the form liners.
Figure 4:
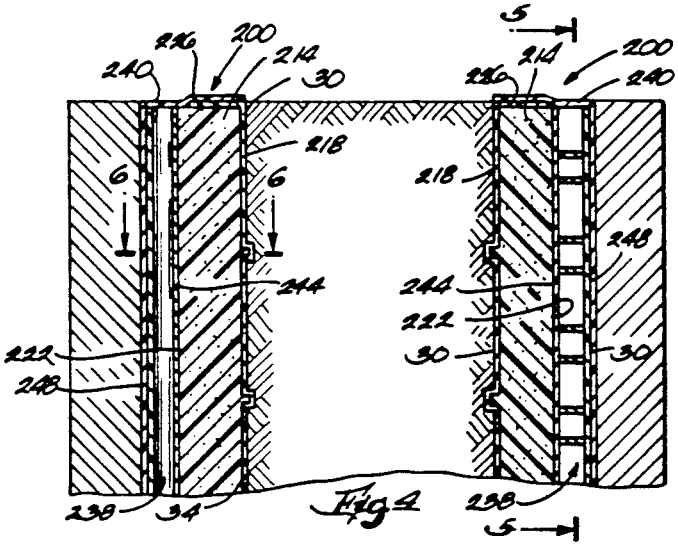
FIG. 4 is an end view of concrete forms and form liners comprising an alternative embodiment of the invention.
Figure 5:
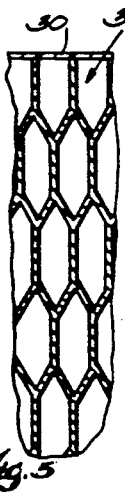
FIG. 5 is a sectional view taken along line 5—5 of FIG. 4.
Figure 6:
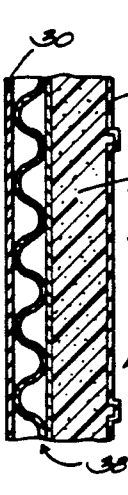
FIG. 6 is a sectional view taken along line 6—6 of FIG. 4.
Figure 7:
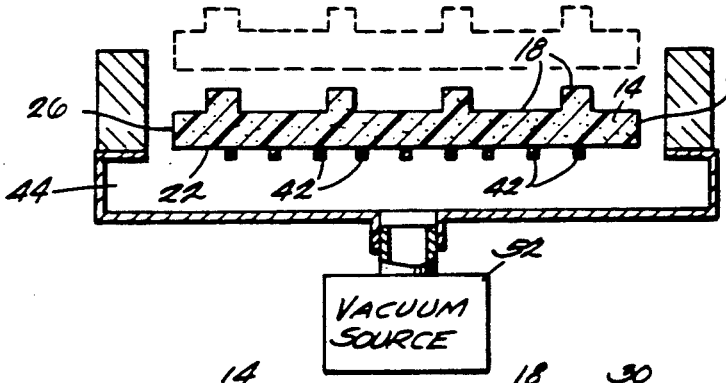
FIGS. 7–12 illustrate a process in accordance with the invention and for manufacturing the form liner of FIG. 1.
Figure 8:
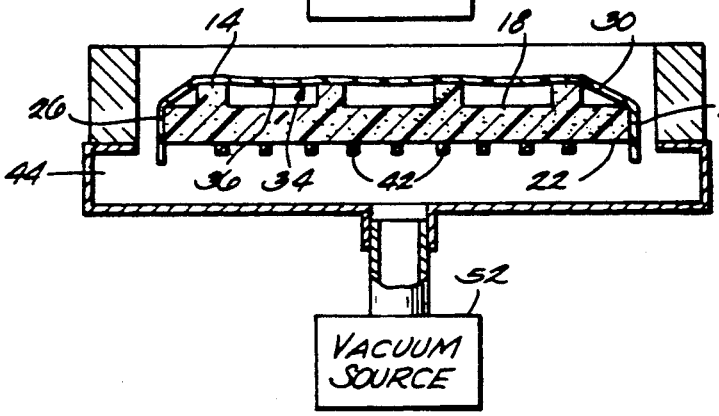
Figure 9:
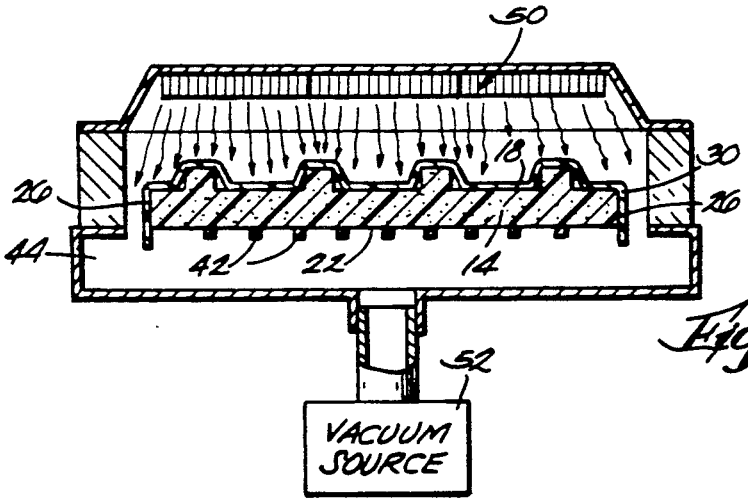
Figure 10:
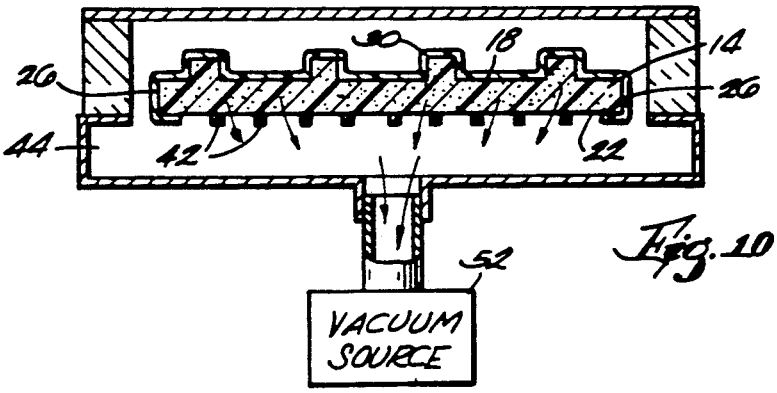

A process for forming concrete is illustrated in FIGS. 3 and 1 and comprises, in order, the following steps. First, a polystyrene foam piece 14 having a surface 18, which is optionally decoratively contoured, is provided. A non-permeable plastic film 30 is then appended to the contoured surface 18 of the polystyrene foam piece 14 (See FIGS. 7-12). Concrete forms 54 are arranged to define a concrete casting area 58

In an alternative embodiment of the invention, the sheet 30 of plastic film appended to the surface 18 of the form liner 14 is coated with a non-solvent release agent, such as non-solvent oil, before the concrete 66 is poured.

The concrete forming process described in conjunction with FIGS. 3 and 1 for forming concrete can utilize the assembly 10 described in conjunction with FIG. 12, the assembly 200 described in conjunction with FIGS. 4, 5, 6 or 14, or the assembly 300 described in conjunction with FIG. 13. The assembly 300 can be advantageously used in the process described in conjunction with FIGS. 3 and 1 in that nails can be driven through the posts 62 into the wood beams 338 so that the assembly 300 is held more firmly in place, an is prevented from rising when concrete is poured.

While a preferred embodiment of the invention has been disclosed, various obvious modifications will be apparent to those skilled in the art. Thus, the protection sought should only be restricted by the spirit and scope of the appended claims.

I claim:

1. A concrete forming member comprising a foam piece adapted for use in concrete casting, the foam piece having a front surface, a back surface, and edges, said forming member further comprising flexible, non-permeable plastic film surrounding said foam piece and covering said front surface, back surface, and edges of said foam piece, said foam piece having defined therein at least one groove extending from said back surface of said foam piece toward said front surface of said foam piece, and said forming member further comprising a wood beam in each groove, each wood beam in each groove including a surface that defines a portion of said back surface of said foam piece.

2. A concrete forming member as set forth in claim 16 wherein said plastic film is defined by first and second sheets of plastic film, and wherein said first and second sheets overlap.

3. A concrete forming member as set forth in claim 1 wherein said plastic film includes an adhesive surface contacting said foam piece.

4. A concrete forming member as set forth in claim 1 wherein said foam piece consists essentially of expanded polystyrene foam.

5. A concrete forming member as set forth in claim 1 wherein said foam piece defines a form liner and said front surface is decoratively contoured.

6. A concrete forming member as set forth in claim 1 wherein said foam piece defines a form liner and said front surface is smooth.

7. A concrete forming member as set forth in claim 1 wherein one of said edges is transverse to said front surface, wherein said plastic film covered front surface and said plastic film covered transverse edge each define a concrete casting surface, said forming member thereby defining a form for defining a brick ledge in casting concrete.

8. A concrete forming member as set forth in claim 1 wherein said plastic film is approximately 10 mils thick.

9. A concrete forming member as set forth in claim 1 wherein said plastic film is a co-extruded olefin based heat activated film.

10. A concrete forming member as set forth in claim 1 wherein said plastic film is reinforced with a mesh formed of a material selected from the group consisting of fiber glass and nylon.

11. A concrete forming member comprising a foam piece adapted for use in concrete casting, the foam piece having a front surface, a back surface, and edges, said forming member further comprising flexible, non-permeable heat shrunk plastic film surrounding said foam piece and covering said front surface, back surface, and edges of said foam piece.

12. A concrete forming member as set forth in claim 11 wherein said plastic film is defined by first and second sheets of plastic film, and wherein said first and second sheets overlap.

13. A concrete forming member as set forth in claim 11 wherein said plastic film includes an adhesive surface contacting said foam piece.

14. A concrete forming member as set forth in claim 11 wherein said foam piece consists essentially of expanded polystyrene foam.

15. A concrete forming member as set forth in claim 11 wherein said foam piece defines a form liner and said front surface is decoratively contoured.

16. A concrete forming member as set forth in claim 11 wherein said foam piece defines a form liner and said front surface is smooth.

17. A concrete forming member as set forth in claim 11 wherein one of said edges is transverse to said front surface, wherein said plastic film covered front surface and said plastic film covered transverse edge each define a concrete casting surface, said forming member thereby defining a form for defining a brick ledge in casting concrete.

18. A concrete forming member as set forth in claim 11 wherein said plastic film is approximately 10 mils thick.

19. A concrete forming member as set forth in claim 11 wherein said foam piece has defined therein at least one groove extending from said back surface of said foam piece towards said front surface of said foam piece, and wherein said assembly further comprises a wood beam in each groove, each wood beam in each groove including a surface that defines a portion of said back surface of said foam piece.

20. A concrete forming member comprising a foam piece adapted for use in concrete casting, the foam piece having a front surface, a back surface, and edges, said foam piece having defined therein at least one groove extending from said back surface of said foam piece toward said front surface of said foam piece, and wherein said forming member further comprises a wood beam in each groove, each wood beam in each groove including a surface that defines a portion of said back surface of said foam piece, said forming member further comprising flexible, non-permeable plastic film surrounding said foam piece and said wood beams and covering said front surface, back surface, and edges of said foam piece.

21. A concrete forming member as set forth in claim 20, wherein said plastic film is defined by first and second sheets of plastic film, and wherein said first and second sheets overlap.

22. A concrete forming member as set forth in claim 20 wherein said plastic film includes an adhesive surface contacting said foam piece.

23. A concrete forming member as set forth in claim 20 wherein said foam piece consists essentially of expanded polystyrene foam.

24. A concrete forming member as set forth in claim 20 wherein said foam piece defines a form liner and said front surface is decoratively contoured.

25. A concrete forming member as set forth in claim 20 wherein said foam piece defines a form liner and said front surface is smooth.

26. A concrete forming member as set forth in claim 20 wherein one of said edges is transverse to said front surface, wherein said plastic film covered front surface and said plastic film covered transverse edge each define a concrete casting surface, said forming member thereby defining a form for defining a brick ledge in casting concrete.

27. A concrete forming member as set forth in claim 20 wherein said plastic film is approximately 10 mils thick.

28. A concrete forming member as set forth in claim 20 wherein said plastic film is a co-extruded olefin based heat activated film.

29. A concrete forming member as set forth in claim 20 wherein said plastic film is reinforced with a mesh formed of a material selected from the group consisting of fiber glass and nylon.

* * * * *